US010285883B2

(12) United States Patent
Miller

(10) Patent No.: US 10,285,883 B2
(45) Date of Patent: May 14, 2019

(54) ADJUSTABLE CHAIR

(71) Applicant: MOTION CONCEPTS L.P., Concord (CA)

(72) Inventor: Greg Bruce Miller, Toronto (CA)

(73) Assignee: Motion Concepts L.P. (CA)

( * ) Notice: Subject to any disclaimer, the term of this patent is extended or adjusted under 35 U.S.C. 154(b) by 0 days.

(21) Appl. No.: 15/512,227

(22) PCT Filed: Sep. 18, 2015

(86) PCT No.: PCT/CA2015/050917
§ 371 (c)(1),
(2) Date: Mar. 17, 2017

(87) PCT Pub. No.: WO2016/041087
PCT Pub. Date: Mar. 24, 2016

(65) Prior Publication Data

US 2017/0246060 A1 Aug. 31, 2017

Related U.S. Application Data

(60) Provisional application No. 62/052,210, filed on Sep. 18, 2014.

(51) Int. Cl.
*A61G 5/10* (2006.01)
*A61G 5/14* (2006.01)
(Continued)

(52) U.S. Cl.
CPC ..... *A61G 5/1059* (2013.01); *A61G 5/107* (2013.01); *A61G 5/1067* (2013.01);
(Continued)

(58) Field of Classification Search
CPC .. A61G 5/1059; A61G 5/1067; A61G 5/1075; A61G 5/107; A61G 5/1056;
(Continued)

(56) References Cited

U.S. PATENT DOCUMENTS 3,123,400 A * 3/1964 Paulson ..... A61G 7/1003 297/314
3,999,799 A * 12/1976 Daswick ..... A47C 3/0257 297/270.3
(Continued)

FOREIGN PATENT DOCUMENTS

CN 201426538 U 3/2010
JP 2008149858 A 7/2008
(Continued)

OTHER PUBLICATIONS

Machine translation of foreign reference JP 2008-149858, obtained from https://www4.j-platpat.inpit.go.jp/cgi-bin/tran_web_cgi_ejje?u=http://www4.j-platpat.inpit.go.jp/eng/translation/2018100503342273494621861291484 33B3B7E587452C64AA39917796BE844CAD (last accessed on Oct. 4, 2018) (Year: 2018).*
(Continued)

*Primary Examiner* — Theodore V Adamos
(74) *Attorney, Agent, or Firm* — Calfee, Halter & Griswold LLP

(57) ABSTRACT

An adjustable chair includes upper and lower base members, a seat assembly secured to the upper base member, and a chair adjusting mechanism. In an embodiment the upper base member is connected to the lower base member by first and second linking members each having a first end connected to the lower base member and a second end slideably received in corresponding first and second arcuate tracks disposed in the upper base member, such that movement of the second ends into and out of the tracks results in vertical movement of the seat assembly relative to the base. In a further embodiment the seat bottom and seat base comprise cooperating arcuate rails, tracks, and/or bearing members, where cooperative action of the arcuate rails, tracks, and/or bearing members enables the seat bottom to tilt relative to the seat base. In a further embodiment the seat bottom and
(Continued)

seat back comprise cooperating arcuate rails, tracks, and/or bearing members, where cooperative action of the arcuate rails, tracks, and/or bearing members enables the seat back to recline relative to the seat bottom.

22 Claims, 13 Drawing Sheets

(51) Int. Cl.
*A47C 1/022* (2006.01)
*A47C 1/024* (2006.01)
*A47C 1/028* (2006.01)
*A47C 3/20* (2006.01)

(52) U.S. Cl.
CPC ..... *A61G 5/1075* (2013.01); *A47C 1/022* (2013.01); *A47C 1/024* (2013.01); *A47C 1/028* (2013.01); *A47C 3/20* (2013.01); *A61G 5/1056* (2013.01); *A61G 5/14* (2013.01)

(58) Field of Classification Search
CPC ..... A61G 5/14; A47C 1/022; A47C 1/024; A47C 1/028; A47C 3/20
USPC .... 297/344.15, 344.16, 344.17, 440.21, 353, 297/354.1, 354.12, 354.13
See application file for complete search history.

(56) References Cited

U.S. PATENT DOCUMENTS 4,394,046 A * 7/1983 Irwin ..... A47D 1/004 297/132
4,515,337 A * 5/1985 Torras ..... B60N 2/39 248/371
4,696,512 A * 9/1987 Burnett ..... A47C 1/035 297/330
4,842,232 A * 6/1989 Pipon ..... B60N 2/0715 248/395
4,856,763 A * 8/1989 Brodersen ..... B60N 2/502 248/564
4,941,709 A * 7/1990 Moller ..... A61B 6/04 297/311
5,810,440 A * 9/1998 Unwalla ..... A47C 1/03294 297/300.2
6,106,065 A * 8/2000 Carroll ..... A47C 1/0347 297/325
6,126,186 A 10/2000 Mascari
6,644,426 B1 * 11/2003 Larue ..... A61G 5/042 180/9.1
7,007,965 B2 * 3/2006 Bernatsky ..... A61G 5/1075 280/250.1
7,273,225 B2 9/2007 Nylander et al.
7,273,255 B2 * 9/2007 Nylander ..... A61G 5/1059 297/330
7,506,932 B2 * 3/2009 Bostrom ..... B60N 2/40 248/421
7,618,095 B2 11/2009 Neilsen
8,038,216 B1 * 10/2011 Palmer ..... A61G 5/14 297/337
8,292,368 B1 * 10/2012 Yarbrough ..... A47C 1/029 297/326
8,478,848 B2 7/2013 Bernatsky et al.
8,876,207 B1 * 11/2014 Chapman ..... B60N 2/265 297/256.11
9,168,940 B1 10/2015 Leszczak et al.
2005/0040626 A1 * 2/2005 Papac ..... A61G 5/12 280/647
2005/0116440 A1 * 6/2005 Bernatsky ..... A61G 5/1062 280/250.1
2006/0061179 A1 3/2006 Brendel et al.
2006/0087166 A1 * 4/2006 Trippensee ..... A61G 5/043 297/338
2009/0085324 A1 * 4/2009 Blauch ..... A61G 5/1075 280/304.1
2010/0132118 A1 6/2010 Robertson
2010/0156065 A1 * 6/2010 Cerreto ..... A61G 5/1067 280/281.1
2011/0258771 A1 * 10/2011 Hammer ..... A61G 5/1002 4/667
2011/0276233 A1 * 11/2011 Lofstrand ..... A61G 5/04 701/49
2012/0038196 A1 * 2/2012 Lawson ..... B64D 11/06 297/354.13
2012/0112507 A1 * 5/2012 Cerreto ..... A61G 5/1067 297/313
2013/0099539 A1 * 4/2013 Fienup ..... A61B 3/024 297/325
2013/0161989 A1 * 6/2013 Ito ..... B60N 2/1615 297/313
2014/0246841 A1 * 9/2014 Slagerman ..... A61G 5/1075 280/220
2017/0273840 A1 * 9/2017 Melgarejo ..... A61G 5/1075

FOREIGN PATENT DOCUMENTS

WO 200027332 A1 5/2000
WO 2007077191 A1 7/2007
WO 2010056193 A1 5/2010
WO WO-2013066198 A1 * 5/2013 ..... A61G 5/1059

OTHER PUBLICATIONS

Machine translation of foreign reference CN 201426538, obtained from https://dialog.proquest.com/professional/patents/docview/1361711630/165A5E14DA55B56ED08/1?accountid=161361 (last accessed on Oct. 4, 2018) (Year: 2018).*
Preliminary Report on Patentability for International Application No. PCT/CA2015/050917 dated Mar. 21, 2017.
Search report from European Patent Application No. 15843026.4 dated Mar. 23, 2018.

* cited by examiner

ADJUSTABLE CHAIR

CROSS-REFERENCE TO RELATED APPLICATION

This application claims the benefit of U.S. Provisional Patent Application Ser. No. 62/052,210, entitled "ADJUSTABLE CHAIR" and filed Sep. 18, 2014, the entire contents of which are incorporated herein by reference, to the extent that they are not conflicting with the present application.

BACKGROUND

Wheelchairs are often provided with one or more seat adjusting mechanisms, for example, to adjust a height (i.e., using a seat lifting mechanism), a tilting angle (i.e., using a seat tilting mechanism), and/or an angle of inclination (i.e., using a seat reclining mechanism). These adjustments may provide for improved comfort, accessibility, and utility.

SUMMARY

According to an exemplary aspect of the present application, an adjustable chair includes a positioning base supported by one or more ground engaging members, and a seat assembly including a bottom member secured to the base. The seat assembly further includes a back member secured to the bottom member by a first arcuate track disposed on one of the bottom member and the back member and a first arcuate rail disposed on the other of the bottom member and the back member and telescopically receivable within the first arcuate track to adjust an angle of inclination of the back member with respect to the bottom member.

According to another exemplary aspect of the present application, an adjustable chair includes a positioning base supported by one or more ground engaging members and a seat secured to the base by a first arcuate track disposed on one of the seat assembly and the base and a first arcuate rail disposed on the other of the seat and the base and telescopically receivable within the first arcuate track to adjust an angle of inclination of the seat with respect to the base.

According to yet another exemplary aspect of the present application, an adjustable chair includes a positioning base supported by one or more ground engaging members, a seat assembly, and first and second chair adjusting mechanisms. The seat assembly includes a bottom member secured to the base and a back member connected to the bottom member. One of the bottom member and the back member includes a first arcuate track, and the other of the bottom member and the back member includes a first bearing member received within the first arcuate track. One of the bottom member and the base includes a second arcuate track and the other of the bottom member and the base includes a second bearing member received within the second arcuate track. The first chair adjusting mechanism is operable to slide the first bearing member within the first arcuate track to adjust an angle of inclination of the back member with respect to the bottom member. The second chair adjusting mechanism operable to slide the second bearing member within the second arcuate track to adjust an angle of inclination of the bottom member with respect to the base.

According to still another inventive aspect of the present application, an adjustable chair includes upper and lower base members, a seat assembly secured to the upper base member, and a chair adjusting mechanism. The lower base member is supported by one or more ground engaging members. The upper base member is connected to the lower base member by first and second linking members each having a first end connected to the lower base member and a second end slideably received in corresponding first and second arcuate tracks disposed in the upper base member. The chair adjusting mechanism is operable to slide the second ends of the first and second linking members within the first and second arcuate tracks to adjust a vertical position of the seat assembly between a lowered position and an elevated position with respect to the lower base member.

DESCRIPTION OF EXEMPLARY EMBODIMENTS

This Detailed Description merely describes exemplary embodiments and is not intended to limit the scope of the claims in any way. Indeed, the invention as claimed is broader than and unlimited by the exemplary embodiments, and the terms used in the claims have their full ordinary meaning. For example, while the specific embodiments described herein are powered wheelchairs, the features of the present application may additionally or alternatively be applied to manually adjustable wheelchairs, or to other types of powered or manual adjustable chairs or seating systems.

As described herein, when one or more components are described as being connected, joined, affixed, coupled, attached, secured, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members or elements.

The present application describes exemplary embodiments of an adjustable chair, such as, for example, a wheelchair, operable to adjust one or more of a lift position of the seat assembly with respect to a ground engaging portion of the chair base, a tilt position of the seat assembly with respect to the chair base, and a reclining position of a seat assembly back member with respect to a seat assembly bottom member.

Figure 1A:
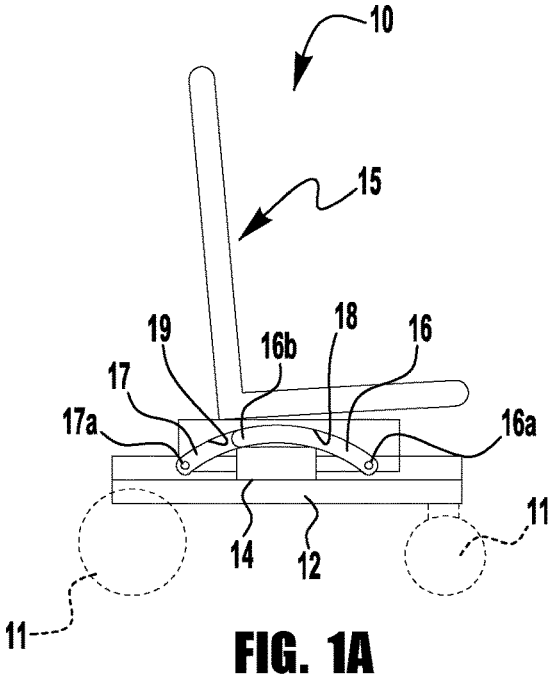
FIG. 1A is a schematic side view of an adjustable chair having a seat lifting mechanism, shown with the seat in the lowered position, in accordance with an exemplary embodiment of the present application.
Figure 1B:
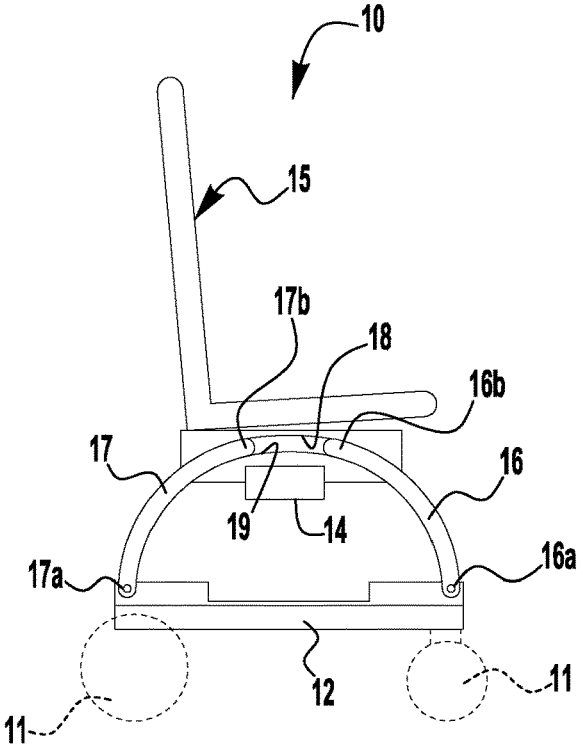
FIG. 1B is a schematic side view of the adjustable chair of FIG. 1A, shown with the seat in the elevated position.

According to an exemplary aspect of the present application, as shown in the schematic view of FIGS. 1A and 1B, a lift mechanism of an adjustable chair 10 may utilize first and second linking members 16, 17 connecting a lower base member 12 supported by one or more ground engaging members 11 (e.g., wheels) to an upper base member 13 secured to a seat assembly 15. The first and second linking members 16, 17 each include a first end 16*a*, 17*a* connected to the lower base member 12 (for example, via guide blocks, as described below) and a second end 16*b*, 17*b* slideably received in corresponding first and second arcuate tracks 18, 19 (which may overlap, as shown) disposed in the upper base member 13. The lift mechanism includes a lift driving mechanism (e.g., a motor, shown schematically at 14) operable to slide the second ends 16*b*, 17*b* of the first and second linking members 16, 17 within the first and second arcuate tracks 18, 19 to adjust a vertical position of the seat assembly 15 between a lowered position (FIG. 1A) and an elevated position (FIG. 1B) with respect to the lower base member 12. While many different types of bearing members may be utilized, in an exemplary embodiment, the first and second linking members 16, 17 may include first and second arcuate lift rails telescopically receivable within the first and second arcuate tracks 18, 19 to adjust the vertical position of the seat assembly 15.

Figure 2A:
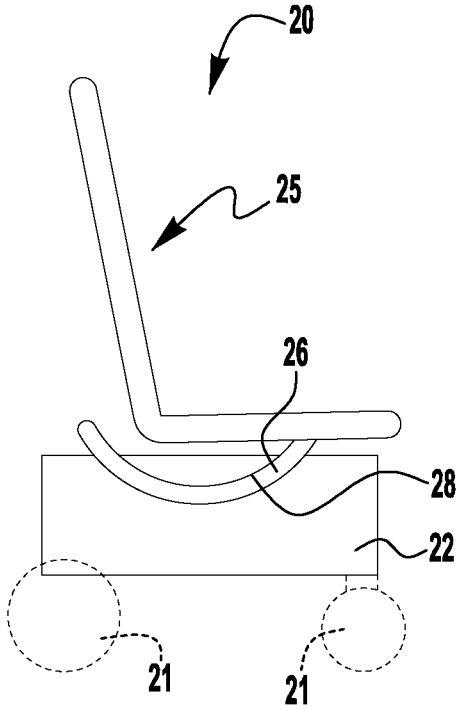
FIG. 2A is a schematic side view of an adjustable chair having a seat tilting mechanism, shown with the seat in the forward tilted position, in accordance with an exemplary embodiment of the present application.
Figure 2B:
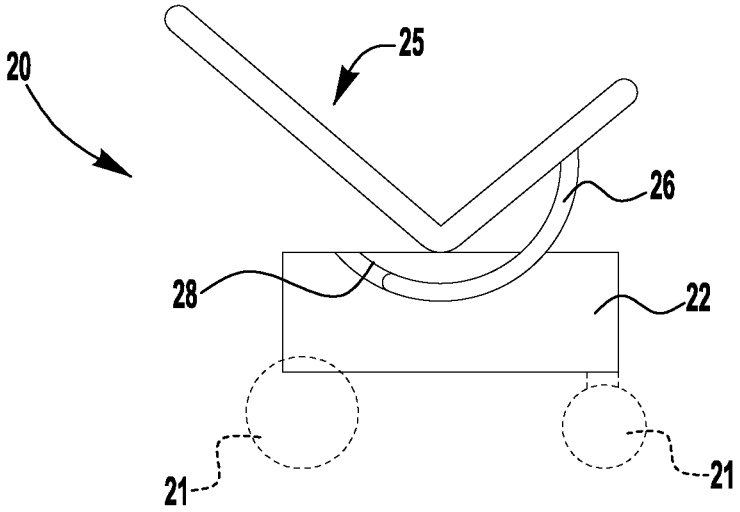
FIG. 2B is a schematic side view of the adjustable chair of FIG. 2A, shown with the seat in the rearward tilted position.

According to another exemplary aspect of the present application, a tilting mechanism of an adjustable chair may utilize at least one arcuate track disposed on one of a positioning base and a seat assembly, and at least one bearing member disposed on the other of the base and the seat assembly. In one exemplary embodiment, as shown in the schematic view of FIGS. 2A and 2B, an adjustable chair 20 includes an arcuate track 28 disposed on a positioning base 22, and a bearing member 26 disposed on a seat assembly 25. The bearing member 26 is slideable within the arcuate track 28 to adjust the angle of inclination (or tilt angle) of the seat assembly 25 with respect to the base 22. In another embodiment (not shown), the tilting mechanism may include an arcuate track disposed on the seat assembly and a bearing member disposed on the base.

While many different types of bearing members may be utilized, in an exemplary embodiment, a bearing member may be shaped to substantially match the arcuate shape of the corresponding arcuate track (e.g., a single arcuate rail, or multiple bearing members arranged to approximate the shape of the arcuate track), such that the sliding movement of the seat assembly with respect to the base produces rotational tilting movement of the seat assembly about a fixed central axis, as defined by the radius of curvature of the track. In one such exemplary embodiment, the arcuate track and corresponding bearing member configuration may be positioned and shaped such that the resulting central axis of rotation coincides with or is proximate to the center of gravity of a user seated in the adjustable chair, or the center of gravity of the user and seat in combination, such that movement of this center of gravity during a tilting operation is limited or minimized. This limited movement of the user's center of gravity may reduce resistance to tilting, requiring reduced power or operator effort to perform the tilting operation, and may improve chair stability by maintaining the user center of gravity in a location well supported by the seat assembly and positioning base.

Figure 3A:
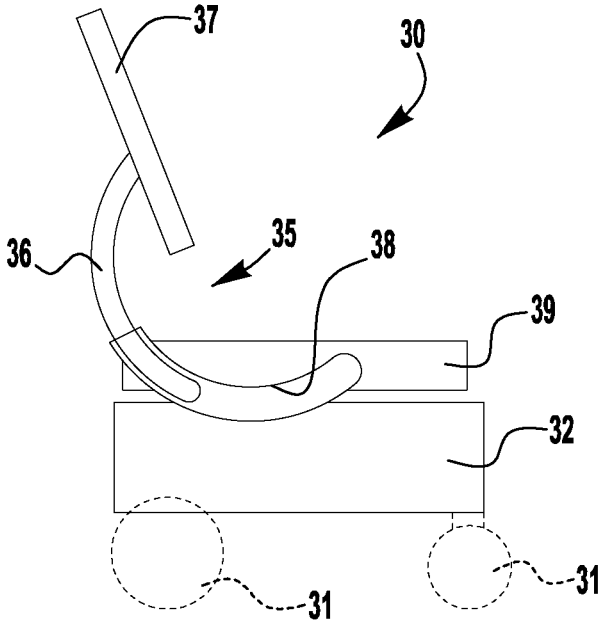
FIG. 3A is a schematic side view of an adjustable chair having a seat reclining mechanism, shown with the seat in the upright position, in accordance with an exemplary embodiment of the present application.
Figure 3B:
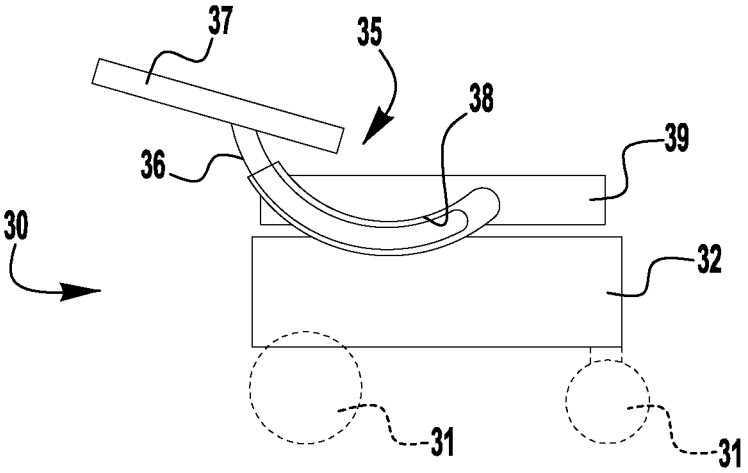
FIG. 3B is a schematic side view of the adjustable chair of FIG. 3A, shown with the seat in the reclined position.

According to yet another exemplary aspect of the present application, a reclining mechanism of an adjustable chair may utilize at least one arcuate track disposed on one of a seat assembly back member and a seat assembly bottom member, and at least one bearing member disposed on the other of the seat assembly back member and the seat assembly bottom member. In one exemplary embodiment, as shown in the schematic view of FIGS. 3A and 3B, an adjustable chair 30 includes an arcuate track 38 disposed on a seat bottom member 39 of a seat assembly 35, and a bearing member 36 disposed on a seat back member 37 of the seat assembly 35. The bearing member is slideable within the arcuate track to adjust the angle of inclination (or reclining angle) of the back member with respect to the bottom member.

While many different types of bearing members may be utilized, in an exemplary embodiment, a bearing member may be shaped to substantially match the arcuate shape of the corresponding arcuate track (e.g., a single arcuate rail, or multiple bearing members arranged to approximate the shape of the arcuate track), such that the sliding movement of the seat back member with respect to the seat bottom member produces rotational reclining movement of the seat back member about a fixed central axis, as defined by the radius of curvature of the track. In one such exemplary embodiment, the arcuate track and corresponding bearing member configuration may be positioned and shaped such that the resulting central axis of rotation coincides with or is proximate to a natural bending pivot (e.g., the hip pivot) location of a user seated in the adjustable chair, such that movement of the back member substantially coincides with movement of the seated user's back. This coincident movement of the back member with the seated user's back may reduce or minimize sliding movement of the user's back with respect to a back supporting surface on the back member (e.g., a back cushion secured to the back member), thereby reducing rubbing of the user's back against the back supporting surface, commonly referred to as back shear, and the discomfort, chafing, and abrasion that often results from back shear. This coincident relative movement may also reduce shear of the user's head on the headrest, improve support, and improve or enhance the ability to use head controls on an exemplary wheelchair.

In some exemplary embodiments, chair adjustment mechanisms including bearing members slideable in corresponding arcuate tracks may utilize manual force applied to the base or seat assembly to adjust the lift, tilt, or reclining positions of the adjustable chair. In other exemplary embodiments, an electrically powered piston driven or rotary force may be applied directly to a frame portion of the positioning base (for lifting movement), the seat assembly (for tilting movement), and/or to the seat back member (for reclining movement) to selectively adjust the chair. Locking components may be utilized to secure the chair in the desired lift, tilt, or reclining position in the absence of application of such forces. According to another aspect of the present application, in an exemplary embodiment, track-guided bearing members may include gear portions operatively engaged by one or more powered gear members (e.g., a spur gear, bevel gear, worm gear, pinion gear, etc.) for sliding movement of the bearing members within the corresponding arcuate tracks. In one such exemplary embodiment, an arcuate rail bearing member may include a notched or toothed gear surface operatively engaged by a worm gear that is driven by a motor (either directly or indirectly, e.g., via one or more of a belt, chain, or additional gears) to slide the arcuate rail within the arcuate track, thereby effecting the desired chair adjustment. This arrangement allows for a compact adjustment mechanism without additional linkages between the positioning base and seat components, and without additional chair locking components.

FIGS. 4-10B illustrate an exemplary embodiment of a wheelchair 100 including exemplary tilting, reclining, and lifting mechanisms. The wheelchair 100 includes a positioning base 110 and a seat assembly 150. The positioning base 110 includes a first or lower base member 120 secured to a set of wheels or other ground engaging members 105 (shown schematically in FIG. 4), and a second or upper base member 130 secured to the lower base member 120 and movable between lowered and elevated positions, as described in greater detail below. The seat assembly 150 is secured to the upper base member 130 and is rotatable with respect to the upper base member 130 to adjust a tilt angle of the seat assembly 150, as described in greater detail below. The seat assembly 150 includes a bottom member 160 secured to the upper base member 130 and a back member 170 secured to the bottom member 160 and rotatable with respect to the bottom member 160 to adjust a reclining angle of the back member 170, as described in greater detail below. The seat assembly 150 may include pads or cushions (not shown) on the base member 160 and back member 170 to provide user contacting surfaces for a user seated in the wheelchair 100.

Figure 8C:
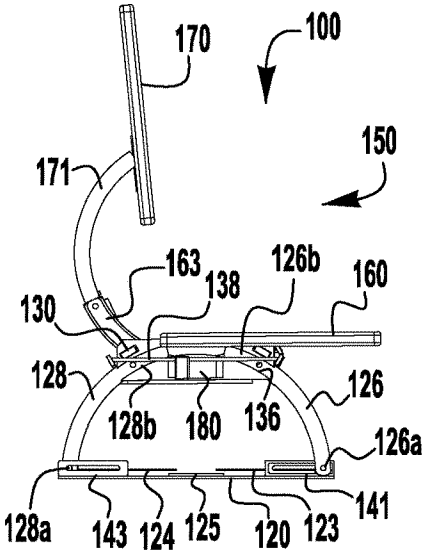
FIG. 8C is a side view of the adjustable chair of FIG. 4, shown with the seat assembly in a fully elevated position.
Figure 8B:
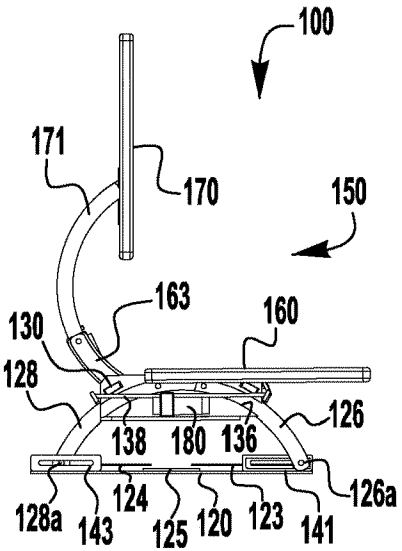
FIG. 8B is a side view of the adjustable chair of FIG. 4, shown with the seat assembly in a partially elevated position.
Figure 8A:
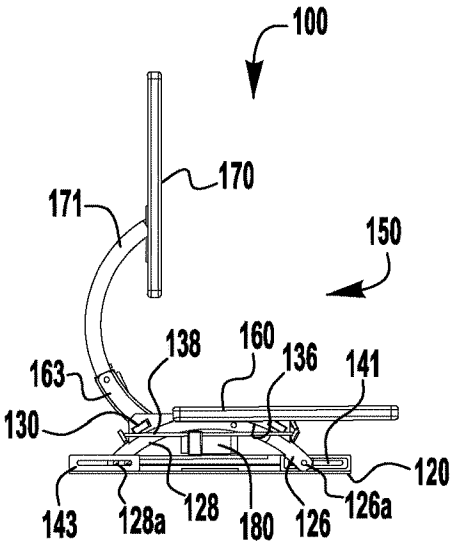
FIG. 8A is a side view of the adjustable chair of FIG. 4, shown with the seat assembly in a lowered position.

Many different lifting mechanisms may be utilized with an adjustable chair to move a seat assembly carrying upper base member between lowered and elevated positions with respect to a lower base member of the chair. In the illustrated example, the adjustable chair 100 includes first and second front linking members or lift rails 126, 127 and first and second rear linking members or lift rails 128, 129 each pivotally connected at a first end, 126*a*, 127*a*, 128*a*, 129*a* to the lower base member 120. In the exemplary embodiment, the first ends 126*a*, 127*a* of the front lift rails 126, 127 are pivotably secured to a front pivot pin 121, and the first ends 128*a*, 129*a* of the rear lift rails 128, 129 are pivotably secured to a rear pivot pin 122. Arcuate shaped second ends 126*b*, 127*b*, 128*b*, 129*b* of the front and rear linking members 126, 127, 128, 129 are telescopically received in corresponding arcuate lift tracks 136, 137, 138, 139 of the upper base member 130. To accommodate telescopic sliding movement of the lift rails within the lift tracks 136, 137, 138, 139, the pivot pins 121, 122 are slideable within slotted guide blocks 141, 142, 143, 144 affixed to the lower base member 120. When the lift rails 126, 127, 128, 129 are telescopically extended further out of the arcuate tracks 136, 137, 138, 139, the lift rails pivot upward, away from the lower base member 120, and the pivot pins 121, 122 slide outward, toward corresponding front and rear ends of the lower base member 120, as shown in FIGS. 4, 5, 8B, and 8C, such that the upper base member 130 and connected seat assembly 150 are raised or elevated with respect to the lower base member 120. When the lift rails 126, 127, 128, 129 are telescopically retracted further into the lift tracks 136, 137, 138, 139, the lift rails pivot downward, toward the lower base member 120, and the pivot pins 121, 122 slide inward, toward a center portion of the lower base member 120, as shown in FIG. 8A, such that the upper base member 130 and connected seat assembly 150 are lowered with respect to the lower base member 120.

Figure 4:
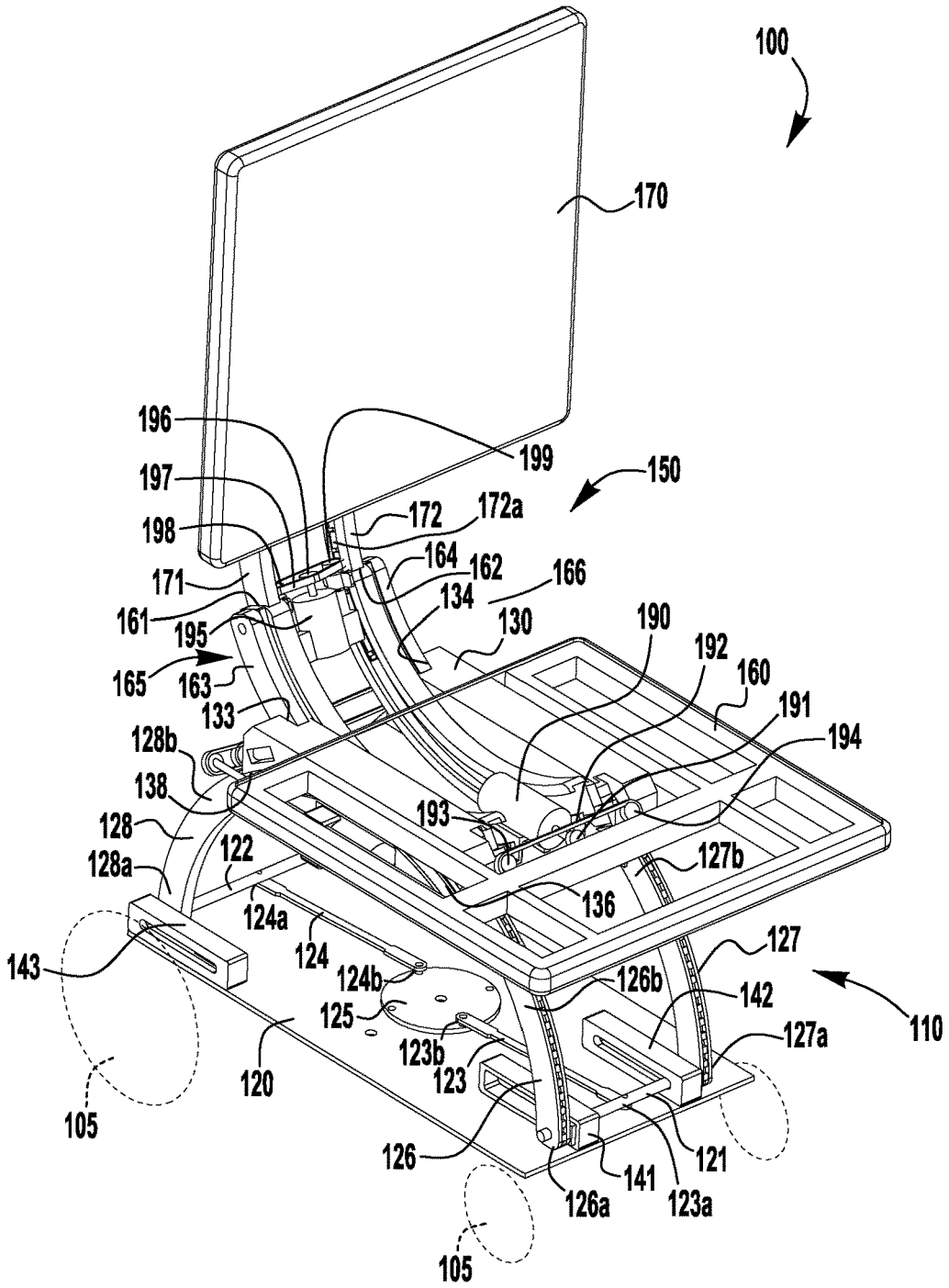
FIG. 4 is an upper front perspective view of an adjustable chair having seat lifting, tilting, and reclining mechanisms, in accordance with an exemplary embodiment of the present application.
Figure 5:
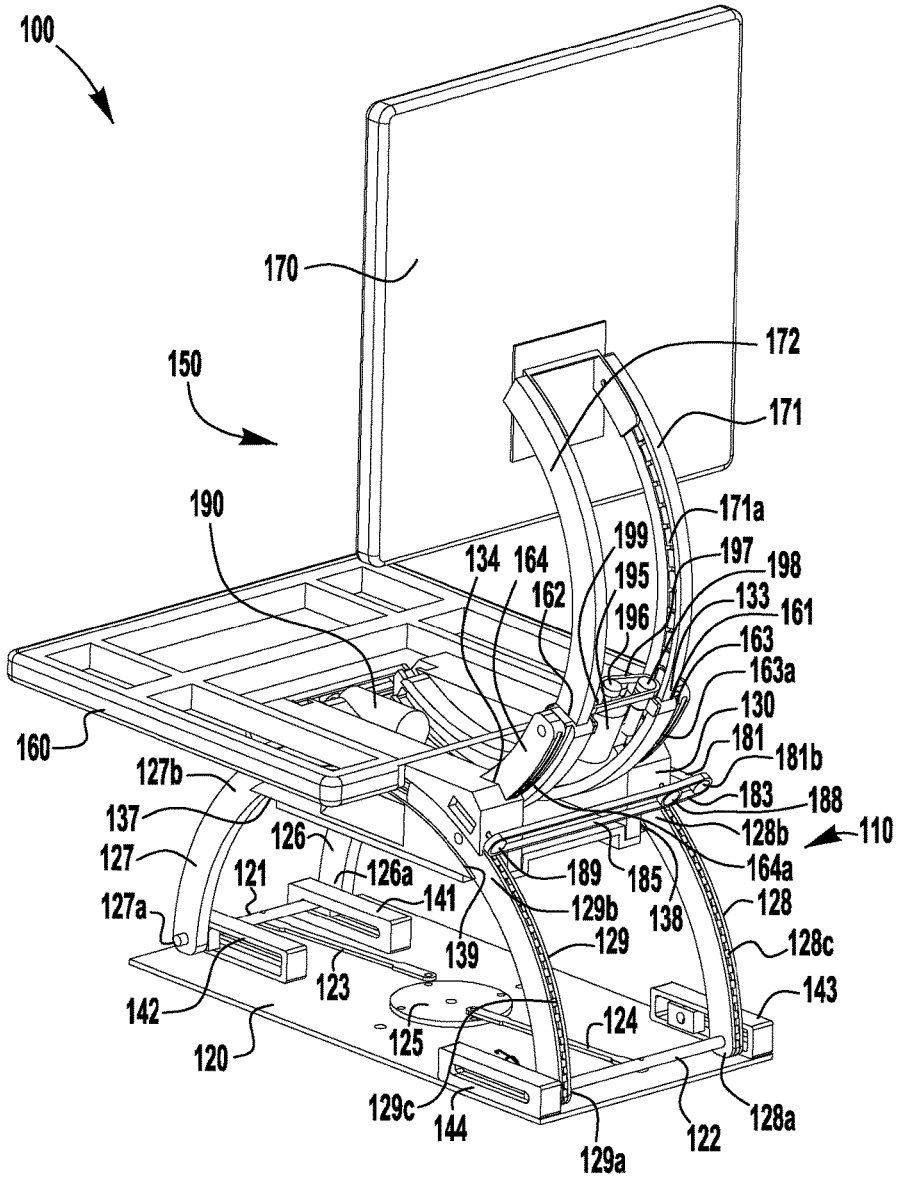
FIG. 5 is an upper rear perspective view of the adjustable chair of FIG. 4.

To maintain the upper base member 130 in a centered (fore/aft) position with respect to the lower base member 120 as the upper base member is raised and lowered, the pivot pins 121, 122 may be linked for uniform opposed sliding movement during actuation. In the illustrated example, as shown in FIGS. 4 and 5, front and rear links 123, 124 are pivotally connected to the pivot pins 121, 122 at outer ends 123*a*, 124*a*, and pivotally connected to a rotating central link 125 at inner ends 123*b*, 124*b*, such that sliding movement of one of the pivot pins 121, 122 causes an equivalent opposed linkage driven sliding movement of the other of the pivot pins 121, 122.

Figure 8D:
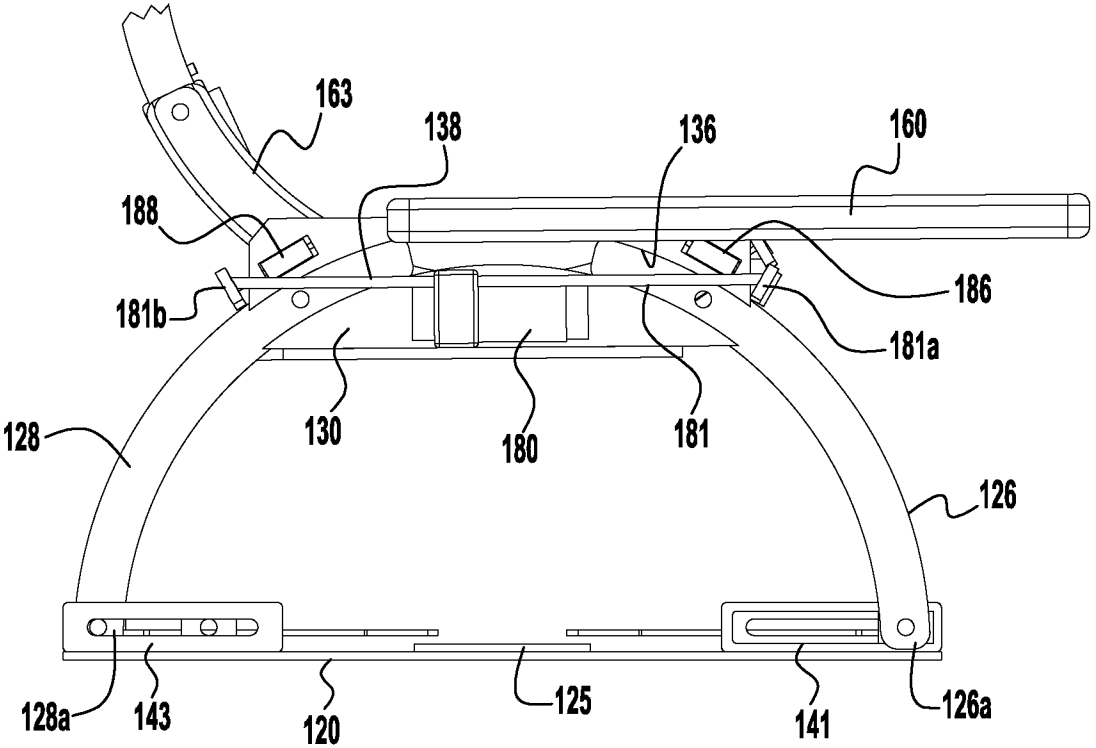
FIG. 8D is an enlarged partial side view of the adjustable chair of FIG. 4, shown with the seat assembly in the fully elevated position.

In the exemplary adjustable chair 100, as shown in FIG. 8D, the chair lifting mechanism includes a lift motor 180 carried by the upper base member 130. The lift motor 180 is operable (e.g., in response to user manipulation of a switch, button, or other control, not shown) to rotate a drive shaft 181 extending toward the front and rear ends of the upper base member 130. The ends of the drive shaft 181 include belt driving gear portions 181*a*, 181*b* that rotate to drive connecting belts 182, 183. The connecting belts 182, 183 (FIGS. 6 and 7) engage and drive first front and rear worm gears 186, 188, which in turn drive front and rear belts 184, 185 that engage and drive second front and rear worm gears 187, 189. The first and second front worm gears 186, 187 engage toothed or notched gear surfaces 126*c*, 127*c* of the first and second front lift rails 126, 127, and the first and second rear worm gears 188, 189 engage toothed or notched gear surfaces 128*c*, 129*c* of the first and second rear lift rails 128, 129. When the lift motor 180 is operated in a first direction, the worm gears 186, 187, 188, 189 are rotated in a first direction (through linked operation of the drive shaft 181, gear portions 181*a*, 181*b*, and belts 182, 183, 184, 185) to telescopically extend the lift rails 126, 127, 128, 129 from the lift tracks 136, 137, 138, 139, thereby raising the upper base member 130 and connected seat assembly 150 with respect to the lower base member 120. When the lift motor 180 is operated in an opposite second direction, the worm gears 186, 187, 188, 189 are rotated in a second direction (through linked operation of the drive shaft 181, gear portions 181*a*, 181*b*, and belts 182, 183, 184, 185) to telescopically retract the lift rails 126, 127, 128, 129 into the lift tracks 136, 137, 138, 139, thereby lowering the upper base member 130 and connected seat assembly 150 with respect to the lower base member 120.

While uniform driving movement of the front and rear gear components by the lift motor 180 and drive shaft 181 provide for uniform lifting of the front and rear portions of the seat assembly 150, in other embodiments of the present application, the adjustable chair may be adapted to provide for non-uniform lifting of front and rear portions of the seat assembly. For example, an adjustable chair may be operable to lift only the rear portion of the seat assembly, or to lift the rear portion of the seat assembly a greater amount than the front portion of the seat assembly is lifted, to move the seat assembly to an anterior or forward tilted orientation. Such an orientation may make it easier for a user to stand from the seated position.

Figure 8E:
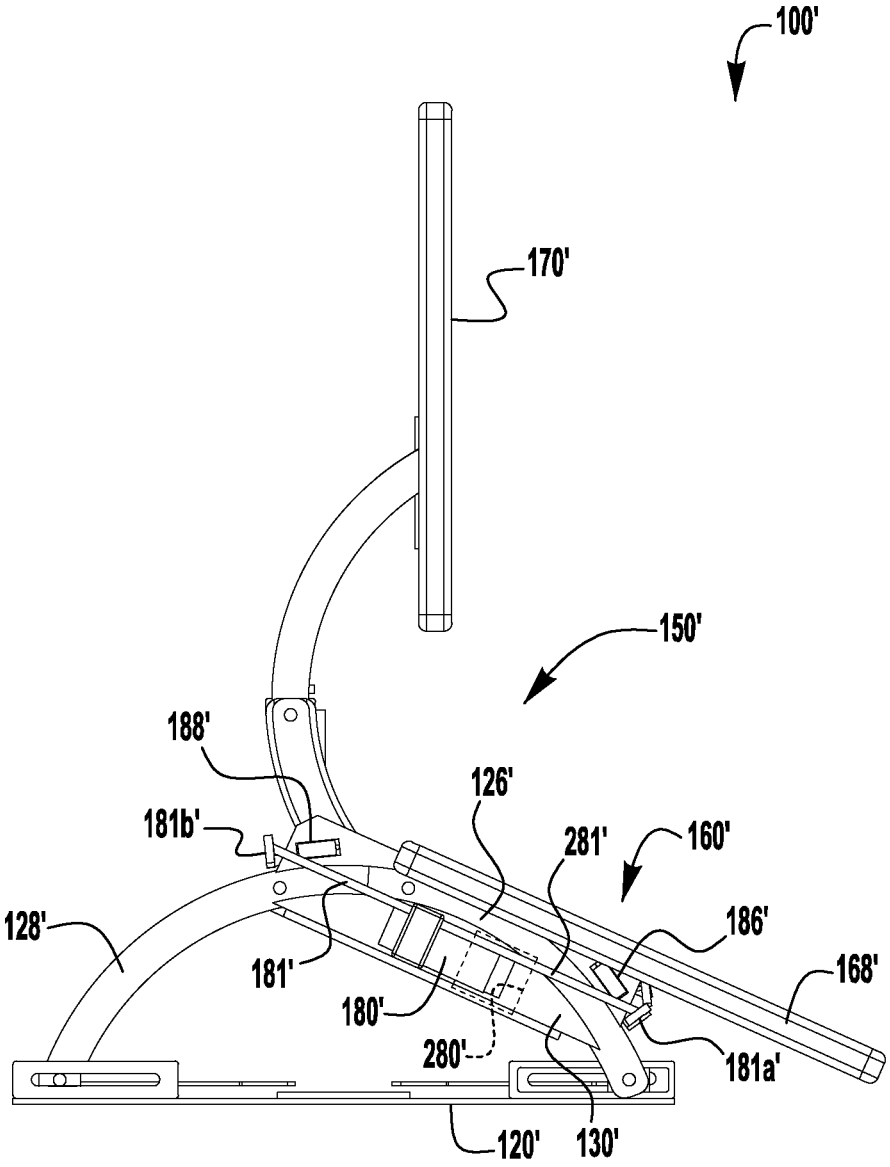
FIG. 8E is a side view of an adjustable chair having a seat lifting mechanism adapted for movement of the seat assembly to an anterior tilting position.

FIG. 8E illustrates an adjustable chair 100' similar to the adjustable chair 100 of FIGS. 4-8D. To provide for non-uniform lifting of the front and rear portions of the seat assembly 150', the lifting mechanism may be adapted such that either or both of the front and rear worm gears 186', 188' may be selectively operatively disconnected from the lift motor 180'. To lift the seat assembly as shown in FIGS. 8A-8C, the front and rear worm gears 186', 188' are both connected with and driven by the lift motor 180'. To lift only the rear portion of the seat assembly 150', as shown in FIG. 8E, the front worm gears 186' may be selectively disconnected from the lift motor 180' prior to or during operation of the lift motor. To lift only the front portion of the seat assembly 150', the rear worm gears 188' may be selectively disconnected from the lift motor 180' prior to or during operation of the lift motor. The disconnected worm gear may be locked out (e.g., by electromechanical pinning or clamping, or using a magnetic brake) to prevent free movement of the worm gear (and the corresponding end portion of the seat assembly) along the corresponding lift rail 126', 128'. In some exemplary embodiments, the disengagement and locking out of the worm gear may be performed by a single function (e.g., an electromechanical or electromagnetic latch that disengages the operative connection and latches the gear component to a fixed element).

Many different arrangements may be used to operatively disconnect the worm gears 186', 188' from the lift motor 180'. For example, the worm gears 186', 188' may be selectively disconnected from the corresponding gear portions 181*a*', 181*b*' (e.g., by an electromechanical clutch system, a releasable electromechanical pinning or clamping, or by electromechanical gear disengagement, or some other disengaging mechanism). As another example, the front and rear gear portions 181*a*', 181*b*' may be selectively disconnected from the drive shaft 181' (e.g., using one or more of the mechanisms mentioned above). As still another example, separate drive shafts 281', 181' may be utilized to connect the front and rear gear portions 181*a*', 181*b*' with the lift motor 180', with the drive shafts 281', 181' being adapted to be selectively disconnected from the lift motor 180' (e.g., using one or more of the mechanisms mentioned above).

Alternatively, non-uniform lifting of the front and rear portions of the seat assembly 150' may be provided using a second lift motor (shown in phantom at 280'). The rear drive shaft may be connected to the first lift motor 180' and the front drive shaft 281' may be connected to the second lift motor 280'. Non-uniform lifting of the front and rear portions of the seat assembly using this arrangement is therefore accomplished by independent, non-uniform operation of the first and second lift motors 180', 280'. A control system of the adjustable chair (not shown) may be programmed to independently operate the first and second lift motors 180', 280' adjust the seat assembly to a desired, pre-programmed tilted position.

Many different tilting mechanisms may be utilized with an adjustable chair to move a seat assembly between forward and tilted rearward positions with respect to a positioning base of the chair. In the illustrated examples, the adjustable chair 100 includes first and second arcuate tilt rails 163, 164 secured to the bottom member 160 of the seat assembly 150, and first and second arcuate tilt tracks 133, 134 disposed in the upper base member 130. The tilt rails 163, 164 are telescopically slideable within the tilt tracks 133, 134 to adjust a tilting position of the seat assembly 150 with respect to the upper base member 130. When the tilt rails 163, 164 are telescopically retracted further into the tilt tracks 133, 134, the seat assembly 150 rotates rearward to tilt the seat assembly in a rearward orientation. When the tilt rails 163, 164 are telescopically extended further out of the tilt tracks 133, 134, the seat assembly 150 rotates forward to return the seat assembly to a forward orientation.

Figure 6:
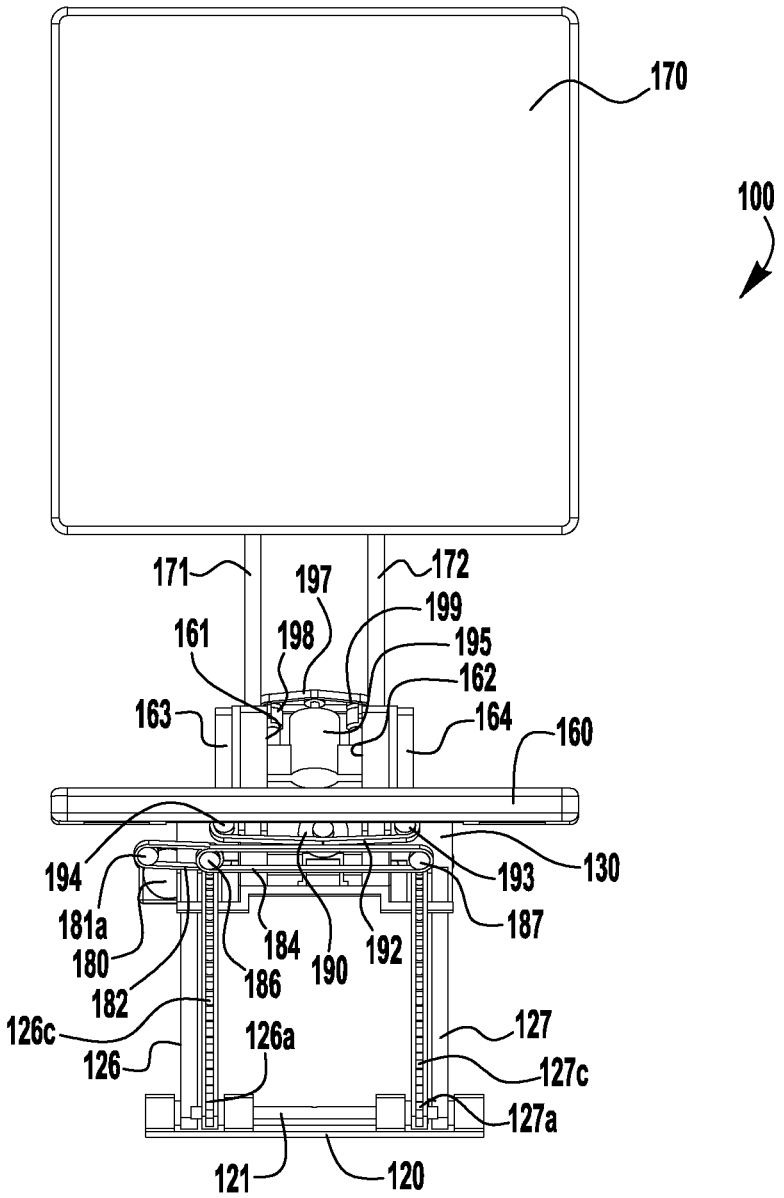
FIG. 6 is a front view of the adjustable chair of FIG. 4.
Figure 7:
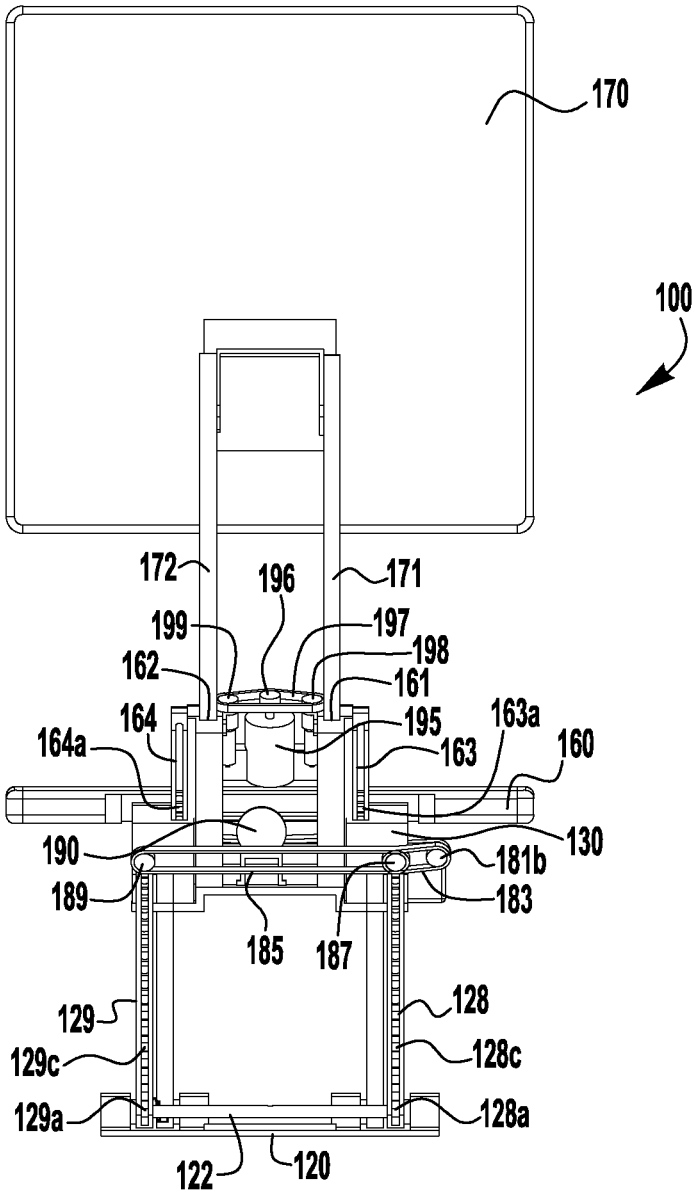
FIG. 7 is a rear view of the adjustable chair of FIG. 4.

In the exemplary adjustable chair 100, as shown in FIGS. 4-6, the chair tilting mechanism includes a tilt motor 190 carried by the upper base member 130. The tilt motor 190 is operable (e.g., in response to user manipulation of a switch, button, or other control, not shown) to rotate a belt driving gear portion 191 that rotates to drive a belt 192. As shown in FIG. 9C, the belt 192 engages and drives first and second worm gears 193, 194. The first and second worm gears 193, 194 engage toothed or notched gear surfaces 163*a*, 164*a* of the first and second tilt rails 163, 164. When the tilt motor 190 is operated in a first direction, the worm gears 193, 194 are rotated in a first direction (through linked operation of the gear portion 191 and belt 192) to telescopically retract the tilt rails 163, 164 further into the tilt tracks 133, 134, thereby rotating the seat assembly 150 rearward to tilt the seat assembly in a rearward orientation (as shown in FIG. 9B). When the motor 190 is operated in an opposite second direction, the worm gears 193, 194 are rotated in a second direction (through linked operation of the gear portion 191 and belt 192) to telescopically extend the tilt rails 163, 164 outward of the tilt tracks 133, 134, thereby rotating the seat assembly 150 forward to return the seat assembly to a forward orientation (as shown in FIG. 9A).

Figure 9A:
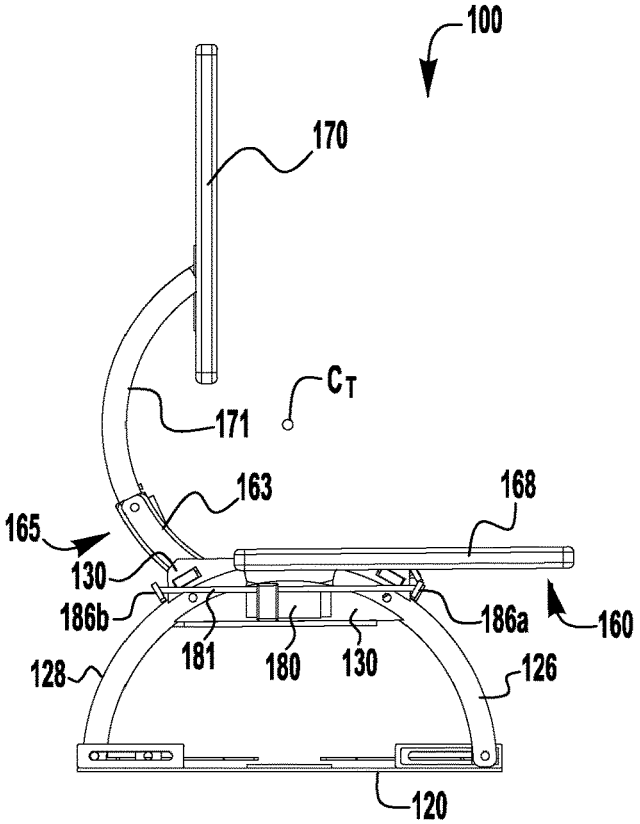
FIG. 9A is a side view of the adjustable chair of FIG. 4, shown with the elevated seat assembly in a forward, untilted position.
Figure 9B:
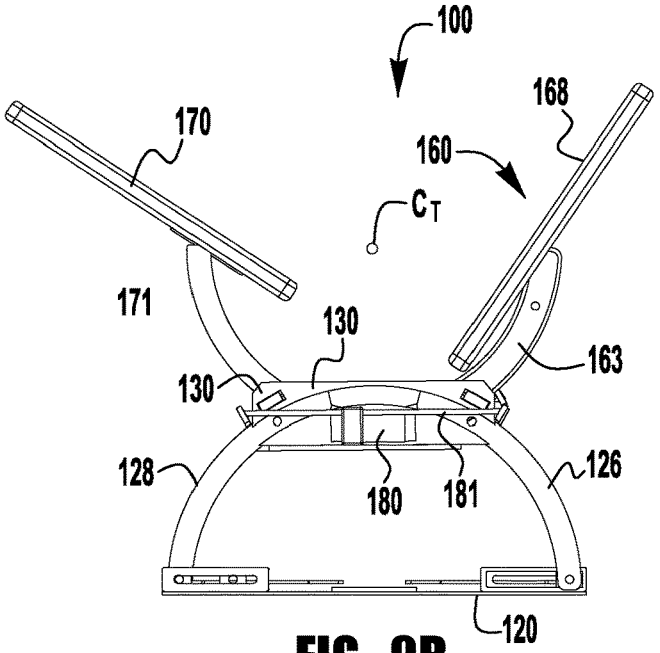
FIG. 9B is a side view of the adjustable chair of FIG. 4, shown with the elevated seat assembly in a rearward, tilted position.
Figure 9C:
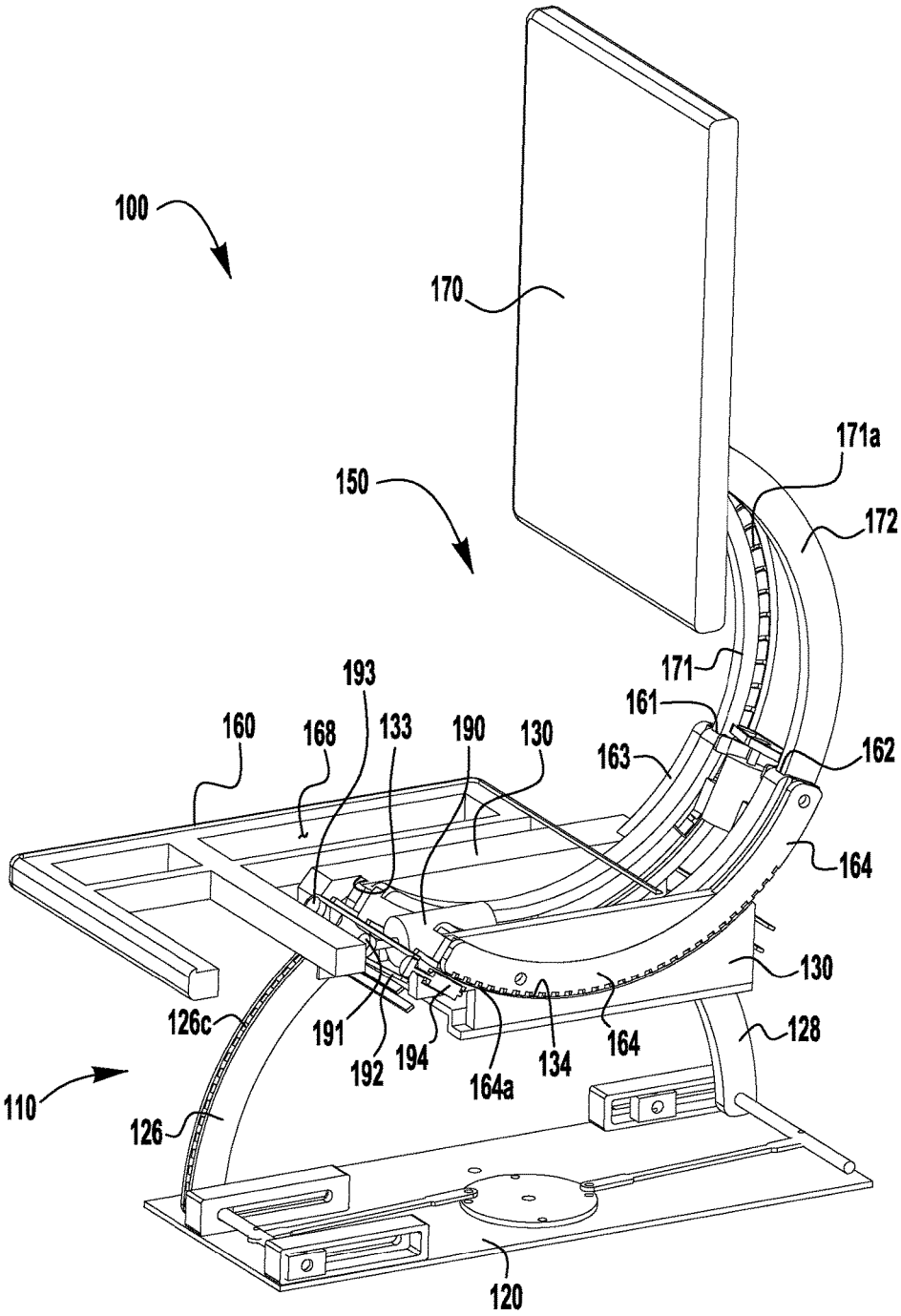
FIG. 9C is a side cross-sectional perspective view of the adjustable chair of FIG. 4.

In the illustrated embodiment, the circular arcuate shape of the tilt rails 163, 164 and the tilt tracks 133, 134 define a fixed center of tilting rotation $C_T$ for the tilting seat assembly, as shown in FIGS. 9A and 9B. In an exemplary embodiment, the chair may be configured such that this center of tilting rotation $C_T$ corresponds to a center of gravity of a user seated in the chair, or alternatively, a center of gravity of the user in combination with the seat. This alignment may facilitate tilting adjustments of the seat assembly, as the weight of the user provides less resistance to tilting movement of the seat assembly. Alignment of the center of tilting rotation $C_T$ with the user's center of gravity may also effectively center the user on the chair across a range of tilting positions to improve balance and support of the user.

In other exemplary embodiments, the chair may be configured such that the center of tilting rotation $C_T$ is proximate to, but not exactly aligned with, the user's center of gravity, or is at least closer to the user's center of gravity than some alternative pivot point on a back or bottom portion of the seat assembly. This arrangement may provide for sufficient support, balance, and ease of adjustment while accommodating other design considerations, such as, for example, a compact or simplified design, or combination with a desirably centered reclining mechanism, as described in greater detail below.

Many different reclining mechanisms may be utilized with an adjustable chair to move a back member of a seat assembly between upright and reclined positions with respect to a bottom member of the seat assembly. In the illustrated example, the adjustable chair 100 includes first and second arcuate recline rails 171, 172 secured to the back member 170 of the seat assembly 150, and first and second arcuate recline tracks 161, 162 disposed on the bottom member 160 of the seat assembly 150. The recline rails 171, 172 are telescopically slideable within the recline tracks 161, 162 to adjust a reclining position of the seat back member 170 with respect to the seat bottom member 160. When the recline rails 171, 172 are telescopically retracted further into the recline tracks 161, 162, the seat back member 170 rotates rearward to recline the seat back member in a reclining orientation. When the recline rails 171, 172 are telescopically extended further out of the recline tracks 161, 162, the seat back member 170 rotates forward to return the seat back member to an upright orientation.

In the exemplary adjustable chair 100, as shown in FIGS. 4-7, the chair reclining mechanism includes a recline motor 195 carried by the seat bottom member 160. The recline motor 195 is operable (e.g., in response to user manipulation of a switch, button, or other control, not shown) to rotate a belt driving gear portion 196 that rotates to drive a belt 197. The belt 197 engages and drives first and second worm gears 198, 199. The first and second worm gears 198, 199 engage toothed or notched gear surfaces 171*a*, 172*a* of the first and second recline rails 171, 172. When the recline motor 195 is operated in a first direction, the worm gears 198, 199 are rotated in a first direction (through linked operation of the gear portion 196 and belt 197) to telescopically retract the recline rails 171, 172 further into the recline tracks 161, 162, thereby rotating the seat back member 170 rearward to recline the seat back member in a reclining orientation. When the recline motor 195 is operated in an opposite second direction, the worm gears 198, 199 are rotated in a second direction (through linked operation of the gear portion 196 and belt 197) to telescopically extend the recline rails 171, 172 outward of the recline tracks 161, 162, thereby rotating the seat back member 170 forward to return the seat back member to an upright orientation.

Figure 10A:
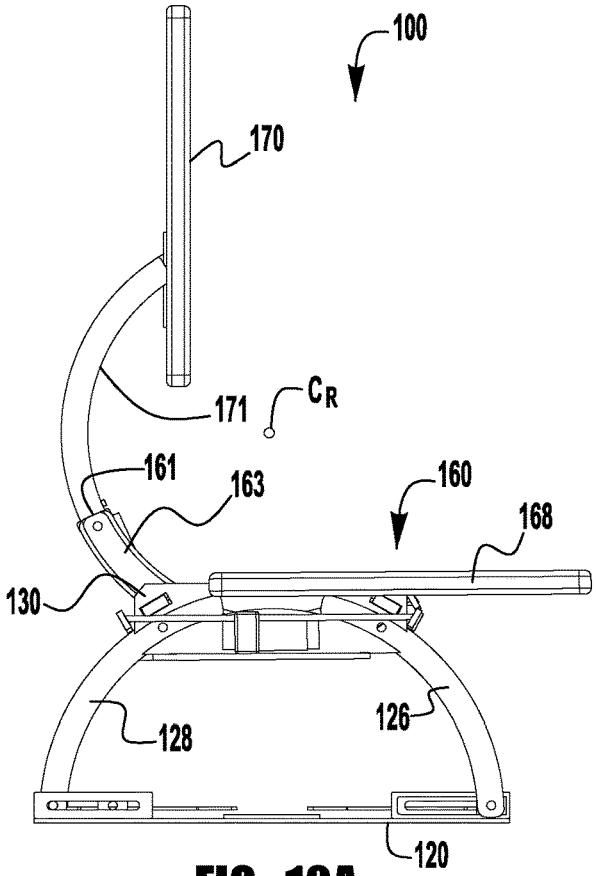
FIG. 10A is a side view of the adjustable chair of FIG. 4, shown with the seat assembly in the fully elevated position and with the seat back member in an upright position.
Figure 10B:
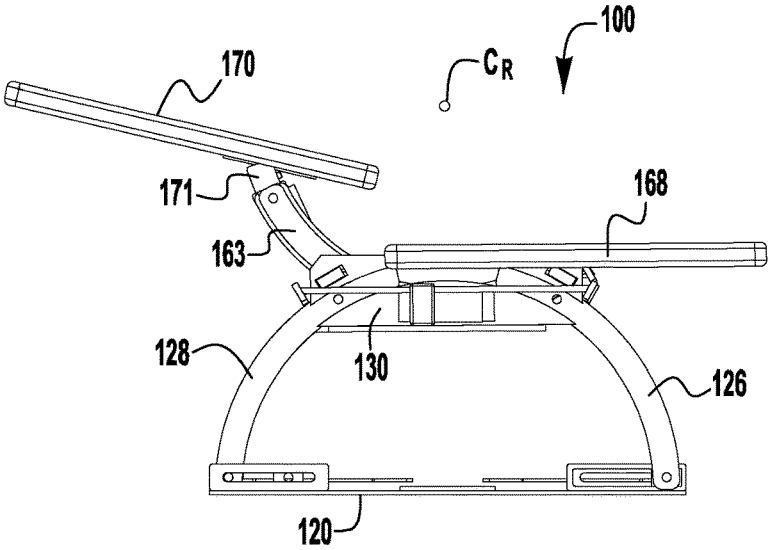
FIG. 10B is a side view of the adjustable chair of FIG. 4, shown with the seat assembly in the fully elevated position and with the seat back member in a reclined position.

In the illustrated embodiment, the circular arcuate shape of the recline rails 171, 172 and the recline tracks 161, 162 define a fixed center of reclining rotation $C_R$ for the reclining seat assembly, as shown in FIGS. 10A and 10B. In an exemplary embodiment, the chair may be configured such that this center of reclining rotation $C_R$ corresponds to an approximate location of a hip joint of a user seated in the chair, such that movement of the back member substantially coincides with movement of the seated user's back. This coincident movement of the back member with the seated user's back may reduce or minimize sliding movement of the user's back with respect to a back supporting surface on the back member (e.g., a back cushion secured to the back member), thereby reducing rubbing of the user's back against the back supporting surface, commonly referred to as back shear, and the discomfort, chafing, and abrasion that often results from back shear. This coincident relative movement may also reduce shear of the user's head on the headrest, improve support, and improve or enhance the ability to use head controls on an exemplary wheelchair.

In other exemplary embodiments, the chair may be configured such that the center of reclining rotation $C_R$ is proximate to, but not exactly aligned with, the user's hip joint location, or is at least closer to the user's center of gravity than some alternative pivot point on a back or bottom portion of the seat assembly. This arrangement may provide for sufficient reduction of back shear while accommodating other design considerations, such as, for example, a compact or simplified design, or combination with a desirably centered tilting mechanism, as described above.

In the illustrated example, the circular arcuate tilt rails 163, 164 and the circular arcuate recline tracks 161, 162 are shaped such that the center of tilting rotation $C_T$ and the center of reclining rotation $C_R$ are substantially aligned. This common center of rotation may be configured to be aligned with the user's center of gravity, with the user's hip pivot location, or at some "compromise" location between center of gravity and hip pivot locations. While many configurations may provide for this alignment, in the illustrated embodiment, the circular arcuate tilt rails 163, 164 and the circular arcuate recline tracks 161, 162 are defined by unitary arcuate members 165, 166 affixed to a frame portion 168 of the seat bottom member 160, with the curvature of the arcuate tilt rails 163, 164 substantially matching the curvature of the arcuate recline tracks 161, 162.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, where components are releasably or removably connected or attached together, any type of releasable connection may be suitable including for example, locking connections, fastened connections, tongue and groove connections, etc. Still further, component geometries, shapes, and dimensions can be modified without changing the overall role or function of the components. Therefore, the inventive concept, in its broader aspects, is not limited to the specific details, the representative apparatus, and illustrative examples shown and described. Accordingly, departures may be made from such details without departing from the spirit or scope of the applicant's general inventive concept.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure, however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention, the inventions instead being set forth in the appended claims. Descriptions of exemplary methods or processes are not limited to inclusion of all steps as being required in all cases, nor is the order that the steps are presented to be construed as required or necessary unless expressly so stated.

I claim:

1. An adjustable chair comprising:

a lower base member supported by one or more ground engaging members;

an upper base member connected to the lower base member by first and second arcuate rails each having a first end connected to the lower base member, the first and second arcuate rails being telescopically slideable in corresponding first and second arcuate tracks disposed in the upper base member to adjust a vertical position of the upper base member between a lowered position and an elevated position with respect to the lower base member; and a seat assembly secured to the upper base member;

wherein the first ends of the first and second arcuate rails are laterally slideable with respect to the lower base member to permit movement of the first ends of the first and second arcuate rails toward each other when the upper base member is moved toward the lowered position, and away from each other when the upper base member is moved toward the elevated position.

2. The adjustable chair of claim 1, wherein the first end of the first arcuate rail is pivotally connected to the lower base member by a first pivot pin, and the first end of the second arcuate rail is pivotally connected to the lower base member by a second pivot pin.

3. The adjustable chair of claim 2, wherein the first and second pivot pins are laterally slideable with respect to the lower base member to permit movement of the first ends of the first and second arcuate rails toward each other when the seat assembly is moved toward the lowered position, and away from each other when the seat assembly is moved toward the elevated position.

4. The adjustable chair of claim 3, further comprising a control linkage having a first end connected to the first pivot pin and a second end connected to the second pivot pin, the control linkage being configured to balance lateral movement of the first and second pivot pins with respect to each other as the seat assembly is adjusted between the lowered and elevated positions to prevent lateral movement of the seat assembly.

5. The adjustable chair of claim 1, further comprising a first gear in operative engagement with a geared portion of the first arcuate rail.

6. The adjustable chair of claim 5, further comprising a motor operable to rotate of the first gear.

7. The adjustable chair of claim 6, further comprising a second gear in operative engagement with a geared portion of the second arcuate rail, wherein the motor is operable to simultaneously rotate the first and second gears.

8. The adjustable chair of claim 7, wherein at least one of the first and second gears is selectively disengageable from the motor to prevent motor operation of a disengaged one of the first and second gears.

9. The adjustable chair of claim 6, further comprising a second gear in operative engagement with a geared portion of the second arcuate rail, and a second motor operable to rotate the second gear.

10. The adjustable chair of claim 1, wherein the seat assembly comprises a bottom member secured to the upper base member, and a back member secured to the bottom member by a third arcuate track disposed on one of the bottom member and the back member and a third arcuate rail disposed on the other of the bottom member and the back member and telescopically receivable within the third arcuate track to adjust an angle of inclination of the back member with respect to the bottom member.

11. The adjustable chair of claim 10, wherein the third arcuate track is disposed on the bottom member and the third arcuate rail is disposed on the back member.

12. The adjustable chair of claim 10, wherein the third arcuate track and the third arcuate rail together define a fixed central axis about which the back member rotates to adjust the angle of inclination.

13. The adjustable chair of claim 12, wherein the fixed central axis is positioned to approximate a hip pivot location of a user seated in the adjustable chair.

14. The adjustable chair of claim 10, further comprising a chair adjusting mechanism operable to slide the third arcuate rail within the third arcuate track to adjust the angle of inclination of the back member with respect to the bottom member.

15. The adjustable chair of claim 14, wherein the chair adjusting mechanism comprises a gear in operative engagement with a geared portion of the first arcuate rail.

16. The adjustable chair of claim 15, wherein the chair adjusting mechanism further comprises a motor operable to drive a belt operatively connected with the gear for rotation of the gear.

17. The adjustable chair of claim 10, further comprising a fourth arcuate track disposed on one of the bottom member and the back member and a fourth arcuate rail disposed on the other of the bottom member and the back member and telescopically receivable within the fourth arcuate track.

18. The adjustable chair of claim 10, wherein the bottom member is secured to the upper base member by a fourth arcuate track disposed on one of the bottom member and the upper base member and at least one bearing member disposed on the other of the bottom member and the upper base member and slideable within the fourth arcuate track to adjust an angle of inclination of the bottom member with respect to the upper base member.

19. The adjustable chair of claim 18, wherein the at least one bearing member comprises a fourth arcuate rail telescopically receivable within the fourth arcuate track.

20. The adjustable chair of claim 19, wherein the bottom member includes an arcuate slide member having a first side defining the third arcuate track and a second side defining the fourth arcuate rail.

21. The adjustable chair of claim 19, wherein the third arcuate track and the third arcuate rail together define a first fixed central axis about which the back member rotates to adjust the angle of inclination, and the fourth arcuate track and the fourth arcuate rail together define a second fixed central axis about which the bottom member rotates.

22. The adjustable chair of claim 21, wherein the first fixed central axis is coaxial with the second fixed central axis.

* * * * *